United States Patent [19]

Harsch

[11] 4,113,149

[45] Sep. 12, 1978

[54] PORTABLE WATER SOURCE

[76] Inventor: Gustav Harsch, 2115 Orchard St., Santa Rosa, Calif. 95404

[21] Appl. No.: 781,199

[22] Filed: Mar. 25, 1977

[51] Int. Cl.[2] ..... B67D 5/06

[52] U.S. Cl. ..... 222/181

[58] Field of Search ..... 222/181, 185, 465, 544, 222/166; 248/318, 148, 150; 150/0.5, 1, 8; 251/351, 346, 347, 356; 239/539

[56] References Cited

U.S. PATENT DOCUMENTS

| | | | |
|---|---|---|---|
| 3,009,679 | 11/1961 | Williams | 251/356 X |
| 3,880,401 | 4/1975 | Wiltse | 251/351 X |
| 4,027,787 | 6/1977 | Bibeau | 222/181 X |

OTHER PUBLICATIONS

Sears, Roebuck Catalogue, 1971, item 3, p. 522, as described on p. 523.

*Primary Examiner*—Kenneth H. Betts
*Assistant Examiner*—Norman L. Stack
*Attorney, Agent, or Firm*—Daniel Jay Tick

[57] ABSTRACT

A plastic waterproof container for storing water has a top hole formed through the top and a bottom hole formed through the bottom. A combination cap and spout device is affixed to the top of the container and covers the top hole for selectively pouring water out of the container when it is used in the manner of a bucket. A handle extends from the top of the container to support the container from an overhead supporting member when it is used as a water source. A spigot device is affixed to the bottom of the container and covers the bottom hole for selectively pouring water out of the container at a desired rate of flow when the container is used as a water source. A volume control device in the container at the bottom in the area of the bottom hole adjusts the volume of water passing through the spigot device.

1 Claim, 5 Drawing Figures

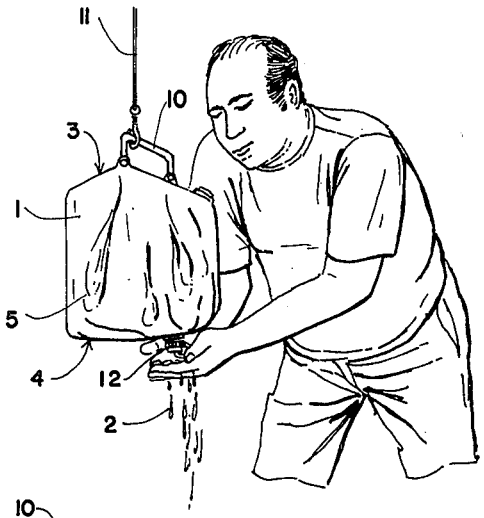
FIG. 1
FIG. 2
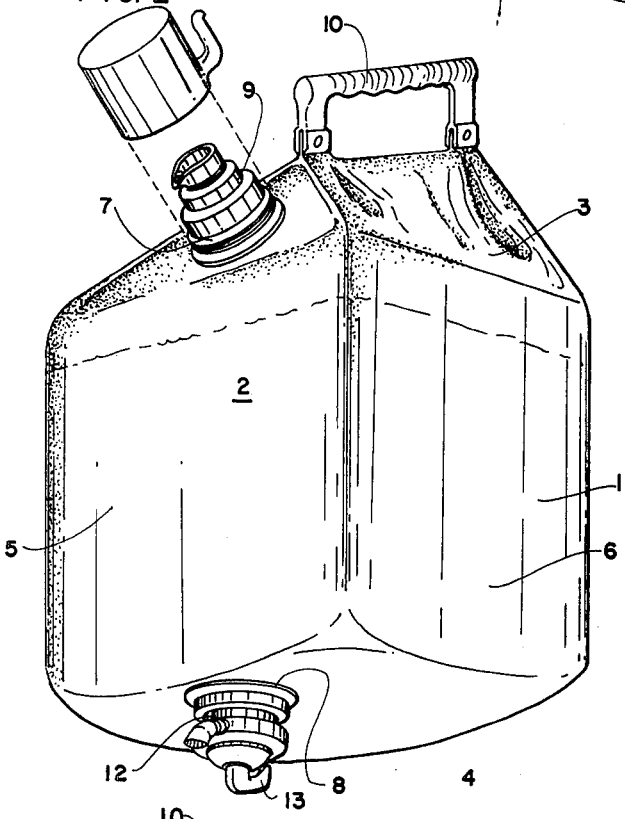
FIG. 3
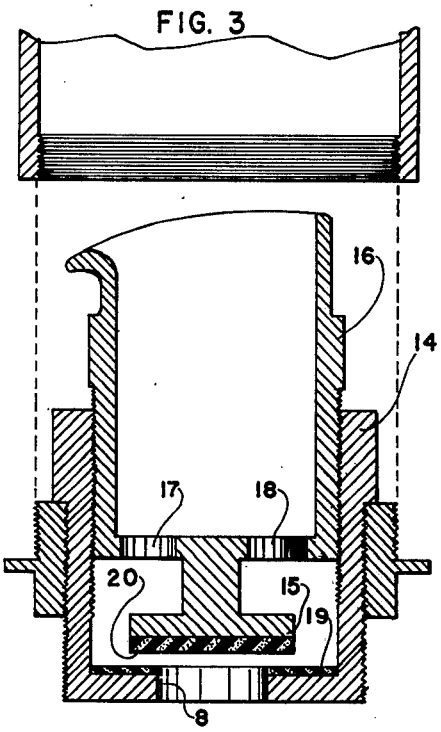
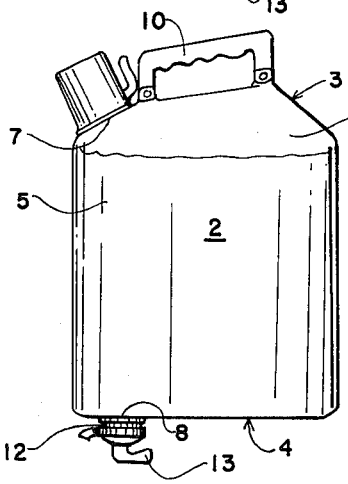
FIG. 4
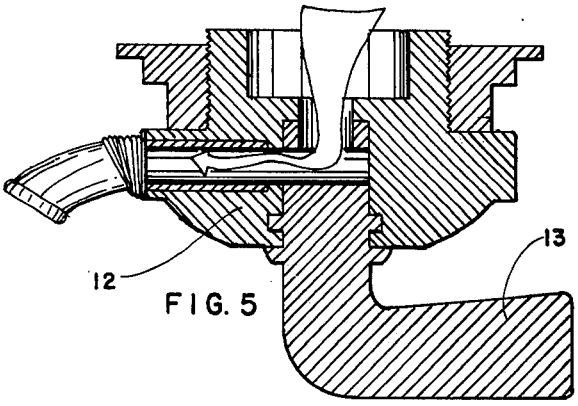
FIG. 5

PORTABLE WATER SOURCE

BACKGROUND OF THE INVENTION

The present invention relates to a portable water source.

Objects of the invention are to provide a portable water source of simple structure, which is inexpensive in manufacture, used with facility, convenience and rapidity as a bucket or an overhead water source, light in weight and readily carried and transportable, and functions efficiently, effectively and reliably to provide a desired amount of water, selectively controlled by the user.

BRIEF DESCRIPTION OF THE DRAWINGS

In order that the invention may be readily carried into effect, it will now be described with reference to the accompanying drawings, wherein:

FIG. 1 is a view of an embodiment of the portable water source of the invention in use as such;

FIG. 2 is a perspective view, on an enlarged scale, of the embodiment of FIG. 1;

FIG. 3 is a sectional view, on an enlarged scale, of an embodiment of the volume control device of the portable water source of the invention;

FIG. 4 is a side view of the embodiment of FIG. 2; and

FIG. 5 is a view, on an enlarged scale, partly in section, of an embodiment of the spigot device of the portable water source of the invention.

DETAILED DESCRIPTION OF THE INVENTION

The portable water source of the invention comprises a plastic waterproof container 1 for storing water 2 (FIGS. 1, 2 and 4). The container 1 has a top 3, a bottom 4 and a plurality of sides 5, 6, and so on, joining the top and bottom, as shown in FIGS. 1, 2 and 4. The container 1 has a top hole 7 formed through the top 3 and a bottom hole 8 formed through the bottom 4 (FIGS. 2 and 4).

A combination cap and spout device 9 (FIG. 2) of any suitable type is affixed to the top 3 of the container 1 and covers the top hole 7. The combination cap and spout device 9 selectively pours water 2 out of the container 1 when said container is used in the manner of a bucket.

A handle 10 is affixed to, and extends from, the top 3 of the container 1 (FIGS. 1, 2 and 4) to facilitate holding said container when used in the manner of a bucket. The handle 10 also supports the container 1 from an overhead supporting member such as, for example, a cross rod, a beam, a tree branch, or the like (not shown in the FIGS.), via a cord 11, as shown in FIG. 1, when the container is used as a water source.

A spigot device 12 of any suitable type (FIGS. 1, 2, 4 and 5) is affixed to the bottom 4 of the container 1 and covers the bottom hole 8 for selectively pouring water out of the container at a desired rate of flow when said container is used as a water source in the manner shown in FIG. 1. The spigot device 12 has a spigot handle 13 outside the container 1 FIGS. 2, 4 and 5) for manual control of the water flow.

In accordance with the invention, a volume control device 14, shown in FIG. 3, is provided in the container

1 at the bottom 4 in the area of the bottom hole 8 for adjusting the volume of water passing into the spigot device 12. The volume control device comprises a stopper 15 extending from the bottom of an inner housing 16, which bottom has flow holes 17, 18, and so on, formed therethrough. The volume control device 14 is initially removed from the container 1 by threadedly decoupling it therefrom and the inner housing 16 is threadedly adjusted so that the stopper 15 is positioned a desired distance from the bottom hole 8 of the container 1. The water 2 stored in the container 1 thus flows through the flow holes 17, 18, and so on and is restricted in volume at the bottom hole 8 in accordance with the distance provided between the stopper 15 and said bottom hole. In order to fully prevent the flow of water from the bottom hole 8, an inside surface of the volume control device and the cooperating surface of the stopper 15 are provided with flexible material such as, for example, rubber 19 and 20, respectively.

While the invention has been described by means of a specific example and in a specific embodiment, I do not wish to be limited thereto, for obvious modifications will occur to those skilled in the art without departing from the spirit and scope of the invention.

I claim:

1. A portable water source, comprising a plastic waterproof container for storing water, said container having a top, a bottom and a plurality of sides joining the top and bottom, said container having a top hole formed through the top and a bottom hole formed through the bottom;

a combination cap and spout device affixed to the top of the container and covering the top hole for selectively pouring water out of the container when said container is used in the manner of a bucket;

a handle affixed to and extending from the top of the container to facilitate holding said container when used in the manner of a bucket and to support said container from an overhead supporting member via a cord when said container is used as a water source;

a spigot device affixed to the bottom of the container and covering the bottom hole for selectively pouring water out of the container at a desired rate of flow when said container is used as a water source, said spigot device having a spigot handle outside said container for manual control of the water flow; and volume control means in the container at the bottom in the area of the bottom hole for adjusting the volume of water passing into the spigot device, said volume control means comprising an inner housing having a bottom with flow holes formed therethrough and a stopper extending from the bottom thereof, said inner housing being threadedly coupled in the container with the stopper positioned a desired distance from the bottom hole of the container whereby water in said container flows into said inner housing and through the flow holes of said inner housing and is restricted in volume at said bottom hole of said container in accordance with the distance between said stopper and said bottom hole.

* * * * *